US005397020A

United States Patent [19]

Witt

[11] Patent Number: 5,397,020

[45] Date of Patent: Mar. 14, 1995

[54] FLEXIBLE TANK LINER WITH VACUUM FITTING

[76] Inventor: F. C. Witt, P.O. Box 488, Claremore, Okla. 74018

[21] Appl. No.: 182,576

[22] Filed: Jan. 18, 1994

[51] Int. Cl.[6] ..... B65D 25/16

[52] U.S. Cl. ..... 220/404; 220/461; 220/420; 220/469

[58] Field of Search ..... 220/403, 404, 461, 420, 220/565, 469

[56] References Cited

U.S. PATENT DOCUMENTS

| | | | |
|---|---|---|---|
| 2,338,604 | 1/1944 | Silveyra | 220/404 |
| 2,346,423 | 4/1944 | Gray | 73/51 |
| 2,762,736 | 9/1956 | Beuglet | 220/420 |
| 2,794,570 | 6/1957 | Downs | 220/461 |
| 3,064,344 | 11/1962 | Arne | 29/421 |
| 3,167,209 | 1/1965 | Jones | 220/403 |
| 3,450,254 | 6/1969 | Miles | 220/404 |
| 3,484,011 | 12/1969 | Greenhalgh et al. | 220/404 |
| 3,848,765 | 11/1974 | Durkop | 220/469 |
| 4,230,061 | 10/1980 | Roberts et al. | 114/74 |
| 4,408,628 | 10/1983 | Monk | 137/312 |
| 4,437,987 | 3/1984 | Thornton | 210/137 |
| 4,524,609 | 6/1985 | Sharp | 73/49.2 |
| 4,537,328 | 8/1985 | Keesee et al. | 220/445 |
| 4,648,563 | 3/1987 | Stock | 220/20.5 |
| 4,653,663 | 3/1987 | Holtsclaw | 220/465 |
| 4,796,676 | 1/1989 | Hendershot et al. | 141/83 |
| 4,920,786 | 5/1990 | Danielson | 73/49.2 |
| 5,072,623 | 12/1991 | Hendershot | 220/469 |
| 5,253,778 | 10/1993 | Sirosh | 220/461 |
| 5,259,895 | 11/1993 | Sharp | 220/469 |

FOREIGN PATENT DOCUMENTS

| | | | |
|---|---|---|---|
| 633127 | 12/1961 | Canada | 220/420 |
| 2225456 | 12/1973 | Germany . | |

*Primary Examiner*—Stephen J. Castellano
*Attorney, Agent, or Firm*—Head & Johnson

[57] ABSTRACT

In a vinyl lined metal tank, the manway or other opening includes a sealed vertical flanged collar that creates a space in the manway between the metal portion of the manway and the vinyl liner. A port extends from the periphery of the flange into communication with the created space. A vacuum maintained within the created space prevents the collapse of the vinyl liner while the tank is empty.

6 Claims, 3 Drawing Sheets

FLEXIBLE TANK LINER WITH VACUUM FITTING

BACKGROUND OF THE INVENTION

This invention relates to the method by which a vacuum may be maintained between the interior of a storage tank and an interior flexible liner to prevent the collapse of the interior flexible liner as the fuel is removed from the storage tank.

The containment of liquids, slurries and other non-solid substances is currently provided by storage tanks. These storage tanks have been built of steel or similar metals in order to provide strength, but have also been built of durable plastics. Many of the storage tanks, particularly those for storing fuels, such as gasoline, heating oil and such, have been installed underground. Other storage tanks have been installed above ground or partially below the surface. Storage tanks are also used for the transport of fluids such as on railroad tank cars, trucks, watercraft and other transportation vehicles.

For a variety of reasons, it has been advantageous to install flexible liners internally within the storage tanks. These flexible liners provide a safety feature, preventing the escape of the stored fluid from the storage tank in the event that stresses, damage or corrosion cause a leak in the storage tank. Where the fuel contained is toxic or otherwise potentially harmful to the environment about the storage tank, the addition of an internal flexible liner has been an effective means of prevention of potential contamination. The presence of an internal flexible liner also serves to prevent the contamination of the stored fluid from external sources, such as ground water in underground tanks which might develop a crack or hole over time, or rainwater and other contaminants which might seep into above ground tanks if similarly damaged.

Many existing storage tanks, particularly underground fuel storage tanks, have been retrofitted with internal flexible liners to prevent ground contamination by potential leaks of the fuel. The flexible liner, whether installed in underground fuel storage tanks or other storage tanks, is typically maintained in place while the storage tank is empty, or only partially full, by means of negative pressure between the external wall of the flexible liner and the internal wall surface of the storage tank. Proper maintenance of the negative pressure or vacuum is not easy.

Therefore, it is a principal object of the invention to provide an improved method for establishing and maintaining the negative pressure or vacuum between the inner wall surface of the solid storage tank and the outer wall surface of the flexible liner, both during installation or replacement of the flexible liner and while the flexible liner is installed.

SUMMARY OF THE INVENTION

The method of maintaining a negative pressure or vacuum between the inside wall of the storage tank and the outside wall of the flexible liner is described. In storage tanks with existing flexible liners or in storage tanks where a flexible liner is to be installed, a separate vacuum collar is positioned within the manway or large vertical opening for the storage tank.

The installation of flexible liners in new or existing underground tanks is done through a large opening, a manway, which is also used to provide access for the pipes and vents used to fill the tank and to withdraw fluids from the tank.

The manway opening must be equipped with a flange on which a gasket is placed. The separate vacuum collar is then inserted into the manway opening so it rests on the gasket which rests on the flange of the storage tank manway opening. Another gasket is placed on top of the vacuum collar and the flexible lining pulled over the second gasket. A third gasket is placed over the flexible lining and a steel ring placed over the gasket. The steel ring, gaskets, flexible lining and vacuum collar are all tightened by bolts to maintain a negative pressure or vacuum seal.

The vacuum collar is specially designed such that it provides tubular paths whereby air from the space between the inner wall of the storage tank and the outer wall of the flexible liner may be drawn out. At the exhaust end, the vacuum collar is equipped with a gauge to indicate the presence of negative pressure or vacuum, and with connectors to connect it to a vacuum pump. The vacuum collar is of a dimension such that it reaches well within the manway opening and maintains the annular space within the manway. Maintenance of the annular space may be retained by standoffs on the outside diameter of the vacuum collar. The collar prevents the flexible lining from adhering to the inside wall of the storage tank manway, thus enabling a vacuum to be maintained within the storage tank, between the inner wall of the storage tank and the outer wall of the flexible lining.

DETAILED DESCRIPTION OF THE PREFERRED EMBODIMENT

Figure 2:
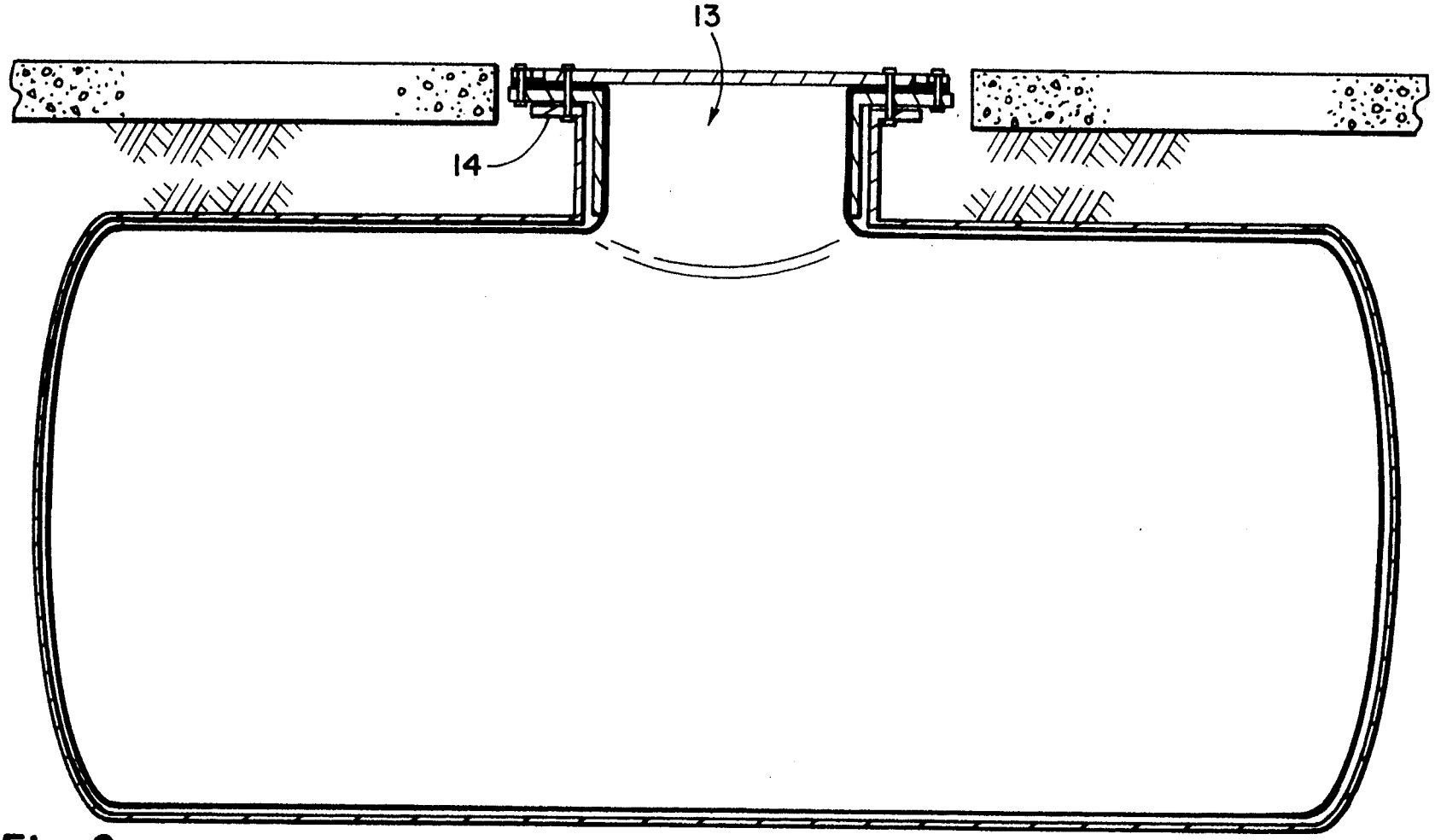
FIG. 2 is a cross-sectional view of the tank along its longitudinal axis, illustrating the flexible liner in the inflated position.

Referring to the drawings, the numeral 10 refers to an underground storage tank which has been positioned beneath ground level 12. A large access opening 13 is shown through which the flexible liner is installed. FIG. 2 shows a cross-section of the underground storage tank with the vacuum collar and flexible liner installed.

Figure 3:
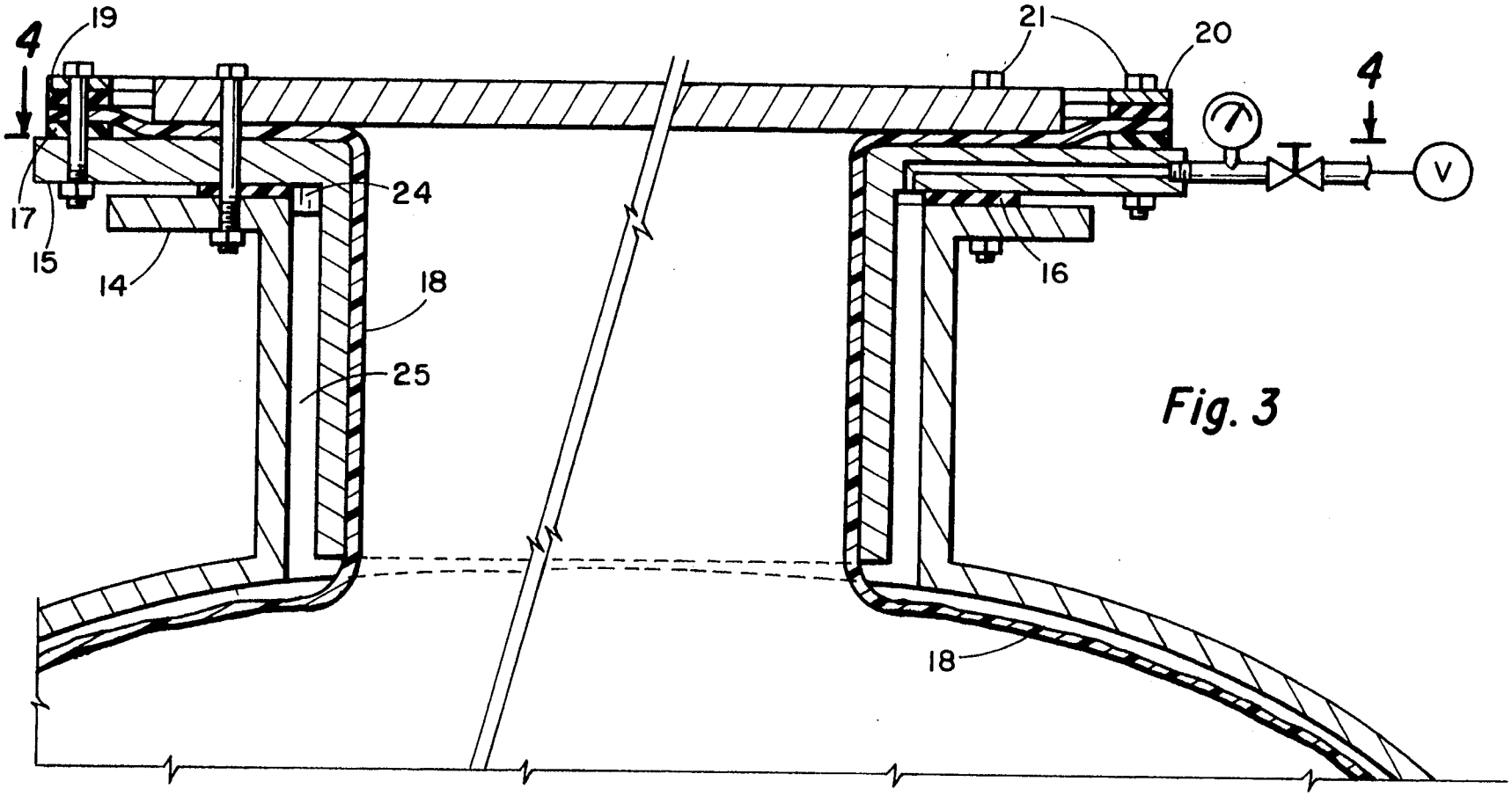
FIG. 3 is an exploded view of the area 1—1 of FIG. 2.

The access opening or manway 13 of the storage tank is equipped with a circumferential flange 14 upon which the vacuum collar 15 rests and to which it is attached. In installation, a first gasket 16 is placed on the manway opening flange. The vacuum collar 15 is then placed inside the manway such that it rests on the first gasket 16. The vacuum collar is attached to the manway opening flange by fastening means such as bolts. A second gasket is placed on the top of the vacuum collar and the flexible liner 18 pulled over the second gasket 17. A third gasket 19 is then placed over the top of the flexible liner. A steel rim 20 is then placed over the third gasket and the assembly secured by fastening means such as bolts 21 as shown in FIG. 3.

Figure 1:
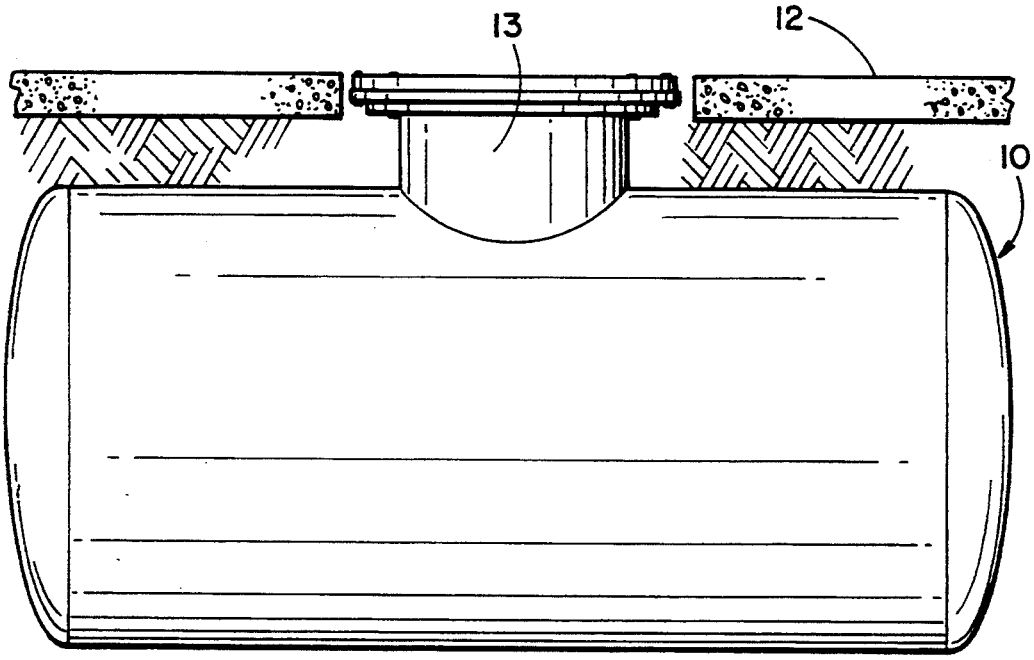
FIG. 1 shows a view of an storage tank installed underground.
Figure 4:
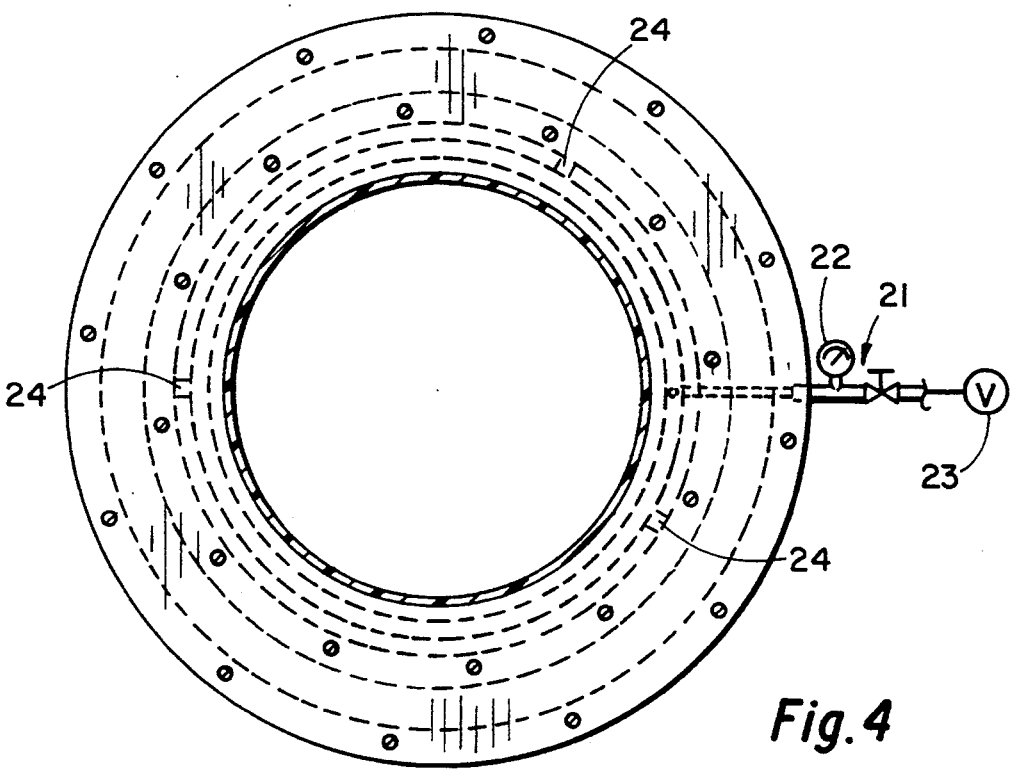
FIG. 4 is a plan view of the manway opening with the vacuum collar installed.

The vacuum collar, FIG. 4, is constructed such that it has a plurality of openings whereby negative pressure or vacuum may be drawn through it and into an exhaust valve 21. The exhaust valve is connected to a gauge 22 which indicates the presence of negative pressure or vacuum and is further connected to a vacuum pump 23. The vacuum collar also contains a plurality of standoffs 24 to allow for an annular space 25 between the inner wall of the manway and the outer wall of the vacuum collar.

The vacuum collar as described may be installed on any storage tank whether such storage tank is underground or above ground, and is intended to facilitate the establishment and maintenance of a negative pressure or vacuum between the inner wall of the storage tank and the outer wall of the flexible lining.

While the invention has been described with a certain degree of particularity, it is manifest that many changes may be made in the details of construction and the arrangement of components without departing from the spirit and scope of this disclosure. It is understood that the invention is not limited to the embodiment set forth herein for purposes of exemplification, but is to be limited only by the scope of the attached claim or claims, including the full range of equivalency to which each element thereof is entitled.

What is claimed:

1. A storage tank, said tank equipped with a flexible liner inside the tank, wherein an external surface of the flexible liner is maintained in close proximity to an internal surface of said storage tank by a vacuum between the internal surface of said storage tank and the external surface of said flexible liner, said storage tank having a manway opening, said flexible liner including a portion that extends into said manway opening, a removable vacuum collar sealably installed within said manway opening, said vacuum collar positioned to create an annular space between the internal surface of the storage tank and the external surface of that portion of the flexible liner within said manway opening;

a conduit in said vacuum collar to controllably connect a vacuum source from an exterior of said tank to said annular space to maintain a vacuum therein.

2. The storage tank as in claim 1, wherein said conduit includes a vacuum gauge, observable from the outside of said storage tank, to show the presence of vacuum within the said annular space.

3. The storage tank of claim 1 including means to sealably connect said flexible liner and said vacuum collar to said manway opening; and removable means to sealably close said manway opening.

4. The storage tank of claims 1 or 3 wherein said manway opening is a protuberant neck connected to said storage tank.

5. The storage tank of claim 3 wherein said manway opening is a protuberant cylindrical neck with an outward flange; said vacuum collar having an outward flange portion sealably connected to said outward flange of said manway opening; said outward flange portion including at least one of said conduit; and means to sealably connect said flexible liner and a removable closure for said manway opening to a top of said outward flange portion.

6. The storage tank of claim 3 wherein said manway opening is a protuberant cylindrical neck with an outward flange; said vacuum collar having an outward flange portion with said conduit therethrough; and means to sealably connect said vacuum collar, said flexible liner and a removable closure to said outward flange.

* * * * *